United States Patent [19]

Gregory

[11] 4,143,694

[45] Mar. 13, 1979

[54] GOLF BAG CONTAINER

[76] Inventor: Frederick S. Gregory, 3721 Northaven Rd., Dallas, Tex. 75229

[21] Appl. No.: 812,257

[22] Filed: Jul. 1, 1977

[51] Int. Cl.[2] ..... A63B 55/00

[52] U.S. Cl. ..... 150/1.5 R; 150/52 R; 206/315 R

[58] Field of Search ..... 150/1.5 R, 1.5 B, 1.5 C, 150/52 R; 206/315 R; 220/4 R

[56] References Cited

U.S. PATENT DOCUMENTS

| | | | |
|---|---|---|---|
| 1,637,538 | 8/1927 | Sampson | 150/1.5 R |
| 2,855,257 | 10/1958 | Barker | 220/4R |
| 3,747,654 | 7/1973 | Wilson | 150/1.5 R |
| 3,901,299 | 8/1975 | Picco | 150/1.5 R |

*Primary Examiner*—Donald F. Norton

*Attorney, Agent, or Firm*—Richards, Harris & Medlock

[57] ABSTRACT

A golf club and bag container includes an upper body which may be releasably secured to a lower body. The lower body is formed to receive the base of a golf club bag and completely surrounds the lower portion of the golf bag. The upper body of the container fits over the golf club heads and upper part of the golf bag and is secured to the lower body section to completely enclose the golf clubs and golf bag.

10 Claims, 11 Drawing Figures

GOLF BAG CONTAINER

BACKGROUND OF THE INVENTION

1. Field of the Invention

The present invention relates to a protective container and more particularly to a container for receiving a golf bag and golf clubs to provide protection and storage during transportation of the golf bag and clubs.

2. Prior Art and Summary of the Invention

With each passing year, the game of golf has become more and more a part of the lifestyle of many Americans and interest in the game has steadily increased. With this increased interest in golf and because each golf course has its own particular characteristics, golfers have become more interested in playing different courses. This of course has required that golf equipment be readily transportable. Moreover, it has become very important that the golf clubs and golf bag be adequately protected and secured during transportation from one locale to another. This has been particularly important when travel is done on commercial carriers, such as airlines, where the golf equipment is separated from the owner during travel.

In the past, only the golf clubs have been provided any degree of protection by being stored in the golf bag with the heads of the clubs being partially protected by covers or by canopy secured over the club heads and attached to the golf bag. While this has provided some protection to the golf clubs, it does not completely protect the clubs and offers no protection whatsoever to the golf bag which may be easily damaged during handling and transportation. Likewise, other golf equipment has to be stored and transported separately because of the limited space for storage provided in the golf bag itself.

Thus, a need has arisen for a strong though light golf equipment container which provides ample storage for both the golf bag and golf clubs of whatever size while providing other storage for other golf equipment.

The present invention provides such a container and includes an upper body which may be releasably secured to the lower body. The lower body is formed to receive the base of a golf club bag and completely surrounds the lower portion of the golf bag. The upper body of the container fits over the golf club heads and upper part of the golf bag and is secured to the lower body section to completely enclose the golf clubs and golf bag.

The lower body of the container has a cylindrical receiving end extending from the main portion of the lower body which closely conforms to the lower end of the golf club bag. In this way, the lower end of the golf bag may be secured in the container to restrict the lower end of the golf bag from movement relative to the container. The lower body of the container has a larger section attached to the cylindrical receiving end and therefore provides additional room for receiving other golf equipment such as golf shoes and the like. The upper end of the upper body substantially conforms to the contour of the golf club heads as they are positioned when the clubs are inserted in the golf bag. An intermediate upper body section is connected to the upper end of the upper body and is substantially larger than the upper end to provide additional storage space for golf equipment.

The intermediate upper body section of the upper body is also formed with an integral handle such that when the upper body is attached to the lower body, the golf bag container may be easily carried by the handle attached thereto. The handle is formed from the upper body such that it does not protrude beyond the circumference of the lower body of the container thereby providing a very streamlined container without any protrusions which would tend to restrict the movement of the container while being loaded or unloaded during transportation.

Additionally, the present container is reinforced with appropriate ribs extending both longitudinally, circumferentially and diagonally along the surface of the container. These ribs add both to the strength as well as to the design of the overall container. The upper body is attached to the lower body section by the use of buckles or straps, as desired.

The container is further formed with a base wall having a protruding foot extending therefrom to form a base plane when the upper body is assembled to the lower body. This plane is opposite the side of the container on which the handle is formed. In this way, the bag may rest with its longitudinal axis in a horizontal position on this base plane such that the handle is along the upper side of the container for ready access.

The handle is also positioned along the longitudinal length of the container such that the handle is set at substantially the center of gravity of the container thereby providing a unit balanced about the handle position.

DESCRIPTION OF THE DRAWINGS

For a more complete understanding of the present invention, and for further details and advantages thereof, reference is now made to the following description taken in conjunction with the accompanying drawings, in which.

DESCRIPTION OF THE PREFERRED EMBODIMENTS

Figure 1:
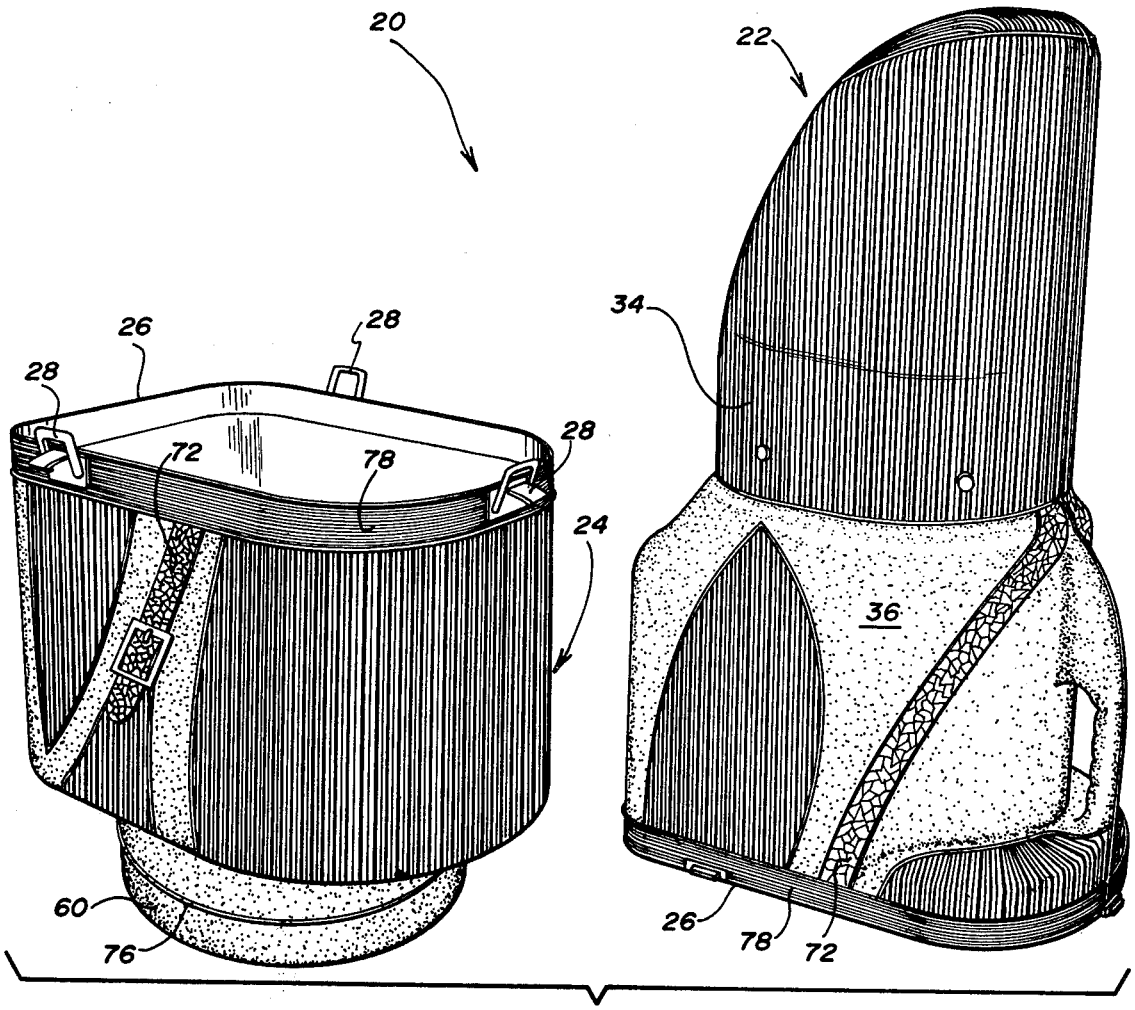
FIG. 1 is a perspective view of a golf equipment container embodying the present invention.

Referring specifically to FIG. 1, there is disclosed a golf bag container 20 embodying the present invention. The container includes an upper body section 22 and a lower body section 24 which are attached along a parting line 26 by buckles 28. Although buckles are shown as the means for connecting the upper and lower body sections, it will be understood that any form of connecting latches, such as straps and the like, may be substituted for buckles without departing from the spirit or scope of the invention.

Figure 10:
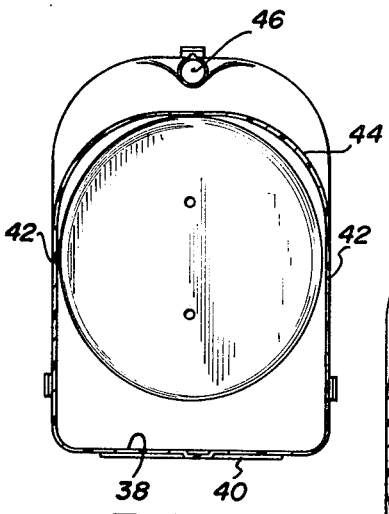
FIG. 10 is a section view taken along lines 10—10 of FIG. 2.
Figures 2, 3, 4, 5:
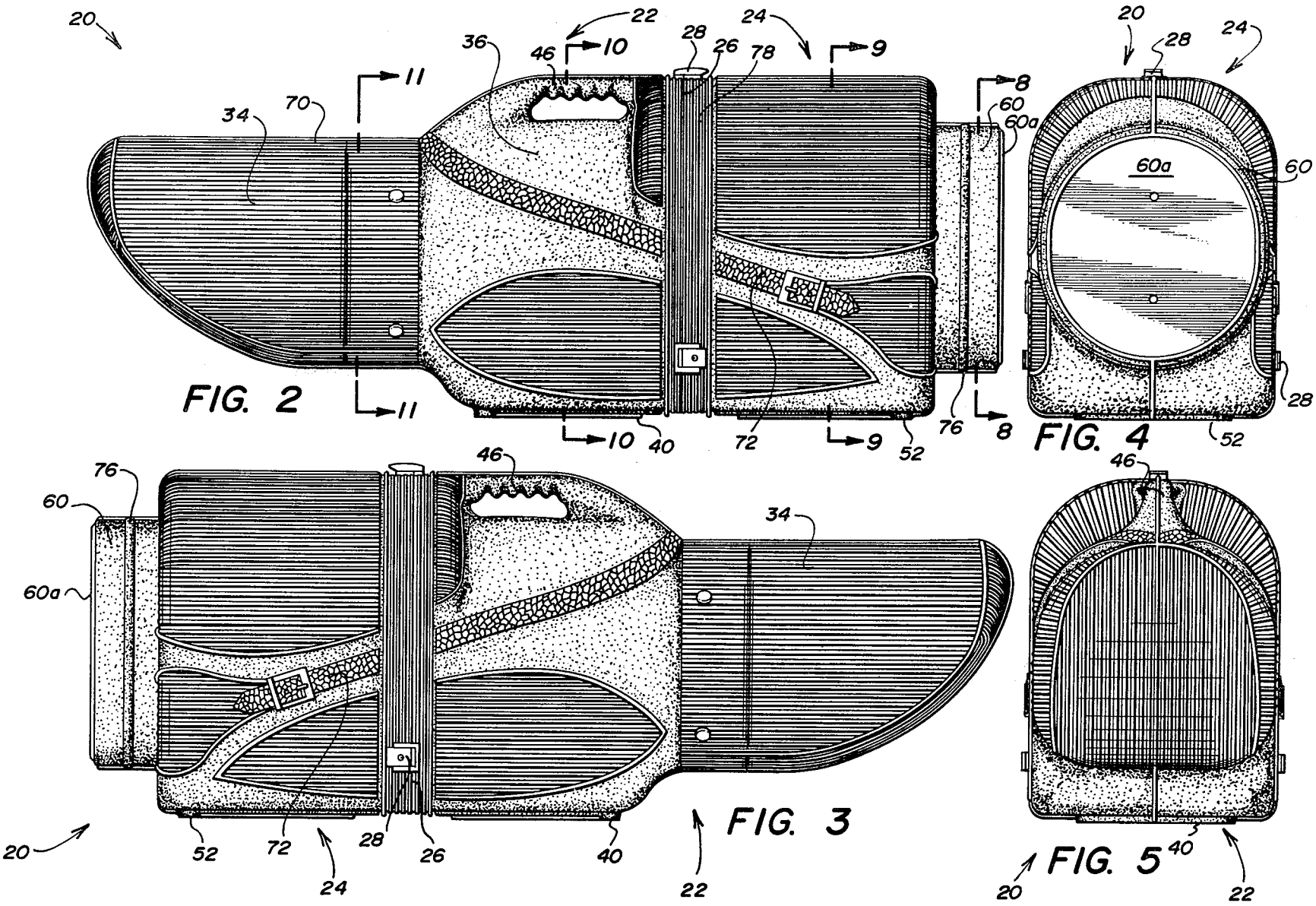
FIG. 2 is a left side elevation.
FIG. 3 is a right side elevation.
FIG. 4 is a bottom view.
FIG. 5 is a top view.
Figure 6:
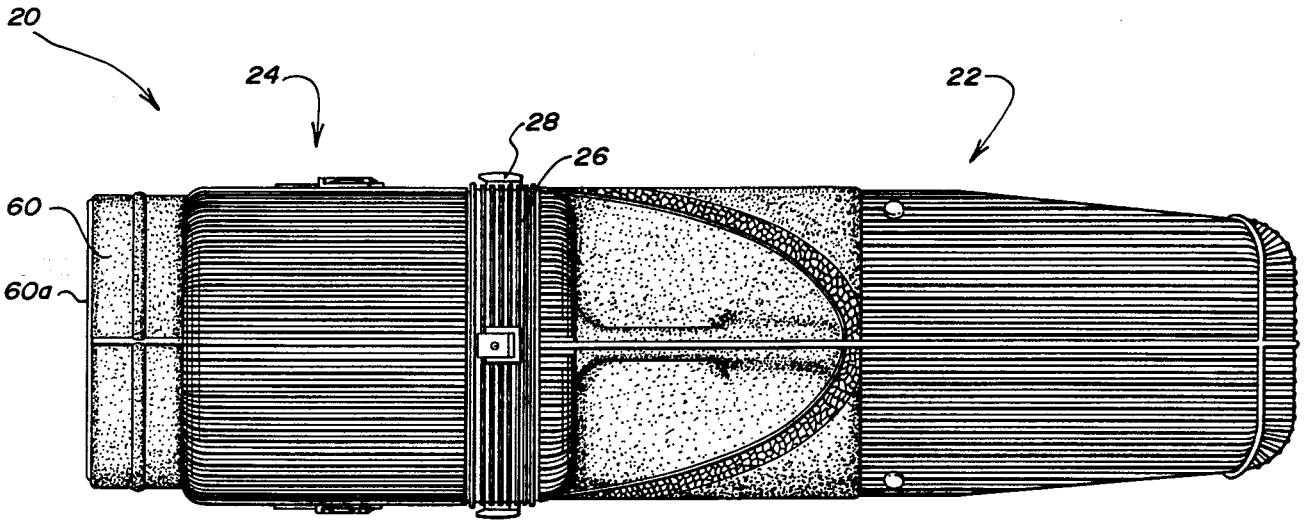
FIG. 6 is a front side view.

Referring now to FIGS. 2 through 7 in addition to FIG. 1, upper body section 22 includes a truncated cylindrical head section 34 integrally attached to an upper body intermediate section 36. Upper body intermediate section 36 includes a substantially planar base wall 38 with a protruding foot 40 formed integrally therewith and extending therefrom. Referring specifically to FIG. 10, side walls 42 extend substantially perpendicularly from the sides of base wall 38 and are connected at their sides remote from base wall 38 by a curvilinear wall 44. As best seen in FIGS. 2 and 6, a handle 46 is formed integrally from upper body intermediate section 36 and is provided with a contour to facilitate gripping of the handle by hand.

Figure 9:
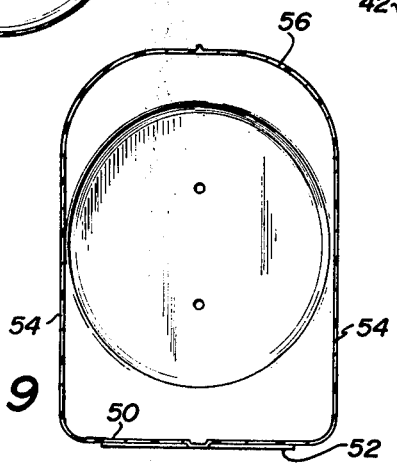
FIG. 9 is a section view taken along lines 9—9 of FIG. 2.
Figure 11:
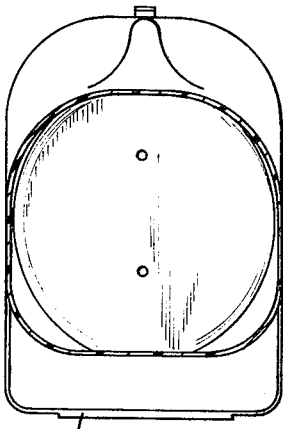
FIG. 11 is a section view taken along lines 11—11 of FIG. 2.

Referring specifically to FIG. 9, lower body section 24 includes a base wall 50 having a protruding foot 52 formed integral therewith and extending therefrom. Side walls 54 extend substantially perpendicularly from the sides of base wall 50 and terminate at their sides remote from base wall 50 in a curvilinear surface 56. By referring to FIG. 2, and by comparing FIG. 9 and FIG. 10, it can be seen that the overall height of the largest section of lower body 24 is substantially equal to the overall height of upper body intermediate section 36 including handle 46. In this way, handle 46 does not protrude above that plane formed by upper curvilinear section 56. This is a significant feature of the present invention in that handle 46 is not overexposed as would be the case if the structure of the container was otherwise. By referring to FIG. 2, it can also be appreciated that the circumference of upper body intermediate section 36 at parting line 26 is substantially identical to that of lower body 24 such that the upper body intermediate section may be readily secured or mated with the lower body to assemble the upper and lower body portions of the container.

Figure 8:
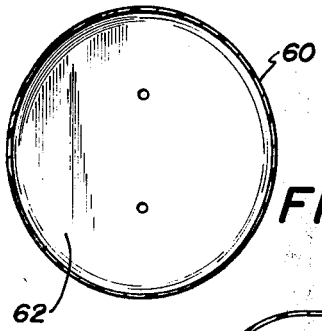
FIG. 8 is a section view taken along lines 8—8 of FIG. 2.

A cylindrical base section 60 is formed integrally from and extending out of lower section 24. Referring specifically to FIG. 8, this section is substantially circular and provides a receiving aperture area 62 to receive and retain the lower end of a golf bag inserted into the container. The inside diameter of aperture 62 formed by cylindrical section 60 is sufficiently large to accommodate substantially all size golf bags. Further, the diameter in section 60 is substantially less than the circumference of lower body 24. Therefore, lower body 24 provides substantial storage space for other golf equipment outside the area occupied by a golf bag space. Therefore, other golf equipment may be stored within the container in addition to the golf bag.

Head section 34 is contoured to receive the golf club heads as they are normally aligned when positioned in a golf bag. Again, head section 34 is sufficiently sized to accommodate a complete set of golf club heads and the overall length of the container is sufficient to accommodate substantially all lengths of golf clubs which may be placed in the container.

Further, upper body intermediate section 36 is larger in circumference than that of head section 34. In this way, room is provided in upper body intermediate section 36 for the storage of other golf equipment in the area surrounding the golf bag and golf clubs which are maintained centrally within the container by head unit 34 and base cylindrical ssection 60.

Figure 7:
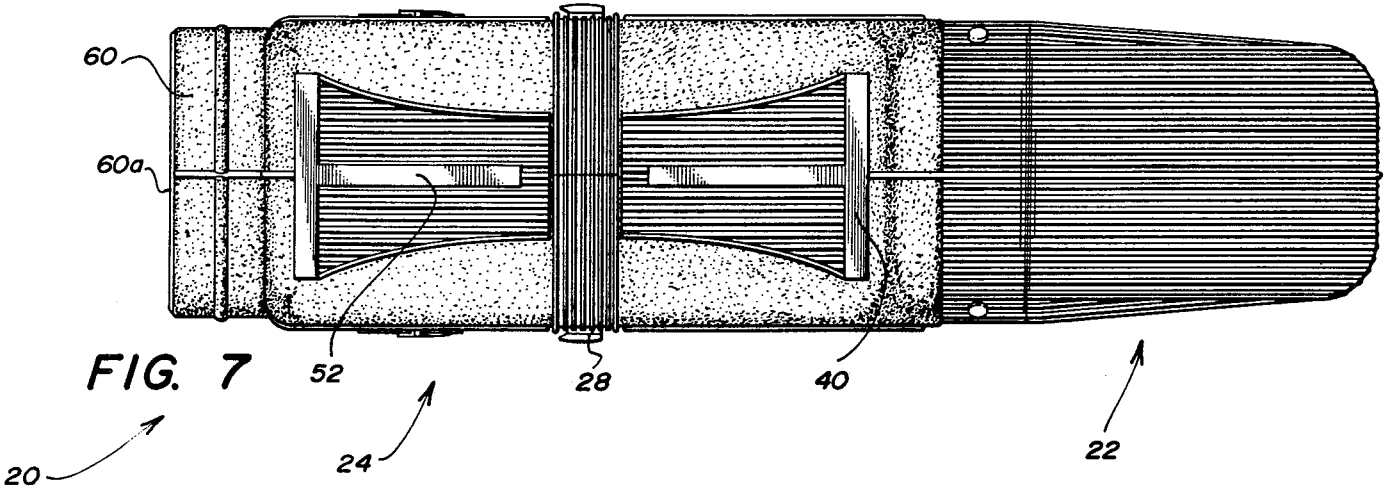
FIG. 7 is a rear side view.

Referring to FIGS. 2 and 7, it can be seen that protruding feet 40 and 52 are formed in the shape of opposing T-sections. These protruding feet provide a platform substantially in a single plane opposite the side of the container on which handle 46 is located. In this way, the container may be rested on the platform provided by protruding feet 40 and 52 such that handle 46 is readily accessible. Likewise, cylindrical base structure 60 forms a planar surface **60*a* on which the container may be rested with handle 46** again being readily accessible to the user of the container.

Handle 46 is appropriately located along the longitudinal axis of the container such that it is substantially at the container's center of gravity. In this way, handle 46 is located at a balance point to facilitate the carrying of the container.

As is illustrated in FIGS. 2 through 7, the head section 34, upper body intermediate section 36, lower body section 24 are formed with appropriate longitudinal ribs 70 which add rigidity as well as a pleasing aesthetic appearance to the container. Integrally molded straps 72 on upper body intermediate section 34 and lower body section 24 add additional diagonal rib support along the longitudinal axis of the container.

Base cylindrical section 60 has a circumferential rib 76 formed therearound to provide additional reinforcement. Like-wise, circumferential ribs 78 are provided immediately adjacent the parting line 26 between intermediate section 36 and lower body 24 to add rigidity at the point of connection between the upper and lower bodies.

Although formation of the container of the present invention may be by many alternative methods, in the primary embodiment, the unit is blow molded or rotational molded from any of the number of suitable plastics such as polyvinyl chloride or polyethylene. Alternatively any suitable polymeric material may be used.

Therefore, the present invention provides a golf bag container which not only provides for protection and storage of a golf bag and golf clubs but also provides for substantial storage around the bags and clubs which are centrally positioned within the container. The container also provides a structure balanced about a carrying handle which is positioned so as not to protrude outside of the circumference of the main body of the container. Further, the present structure provides for protruding feet or runners opposite the handle which forms a planar base on which the container may be rested. The container also includes longitudinal, diagonal and circumferential ribs about the container to reinforce as well as add aesthetic appearance to the container.

Although the preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. The present invention is therefore intended to emcompass such rearrangements, modifications and substitutions of parts and elements as fall within the scope of the appended claims.

What is claimed is:

1. A substantially rigid, golf bag container comprising:

an upper body including an intermediate section having integral handle means formed thereon, a substantially flat base opposite the integral handle means for supporting the container thereon, and a truncated cylindrical head section extending from and integral with the intermediate section, a lower body including a substantially flat base and a curvilinear surface opposite the flat base, a cylindrical golf bag receiving end extending from an integral with said lower body, and means for releasably securing the lower body opposite said cylindrical receiving end to the upper body opposite said head section such that the base of said lower body is aligned in substantially the same plane as the base of said upper body.

2. The golf bag container of claim 1 further comprising:

a cylindrical receiving cavity formed in said cylindrical golf bag receiving end for receiving and supporting one end of a golf bag.

3. The golf bag container of claim 1 further comprising:

a first protruding foot extending from the base of said upper body, and a second protruding foot extending from the base of said lower body.

4. The golf bag container of claim 1 comprised of a plastic material.

5. The golf bag container of claim 1 wherein the thickness of the container is from about 100 millimeters to about 124 millimeters.

6. The golf bag container of claim 1 further comprising ribs extending along the longitudinal length of the head section of said upper body and along said lower body to add ridigity to the container.

7. A substantially rigid golf bag container comprising:

an upper body intermediate section having a base, two upwardly extending side walls from the base and a curved top, a handle means formed from the curved top of said intermediate upper body section, a substantially cylindrical upper body head secton attached to and extending from said upper body intermediate section, said head section having a circumference less than the circumference of said upper body intermediate section, a lower body including a base, two upwardly extending side walls from the base and a curved top attached to said side walls opposite said base, the said lower body having substantially the same width as said upper body intermediate section and a height equal to the height of said upper body intermediate section including said handle means such that when said lower body is attached to said upper body intermediate section said handle means does not protrude beyond the outer circumference of said lower body, a cylindrical base platform extending from said lower body and having a circumference less than the circumference of said lower body, and means for releasably securing the lower body to said upper body intermediate section such that the base of said lower body is aligned and is in substantially the same plane as the base of said upper body intermediate section.

8. The golf bag container of claim 7 further comprising:

a first protruding foot extending from said upper body intermediate section base, and a second protruding foot extending from said lower body base.

9. The golf bag container of claim 7 further comprising:

rib means extending diagonally from said handle means across both sides of said upper body intermediate section, and integral rib means extending longitudinally along both sides of said lower body to add rigidity to said golf bag container.

10. The golf bag container of claim 7 further comprising:

a receiving receptical formed in said cylindrical end platform for receiving the lower end of a golf bag.

* * * * *